US007536888B2

(12) United States Patent
Yamakawa et al.

(10) Patent No.: US 7,536,888 B2
(45) Date of Patent: May 26, 2009

(54) PROCESS FOR MANUFACTURING A SEAMLESS TUBE

(75) Inventors: Tomio Yamakawa, Kawanishi (JP); Kazuhiro Shimoda, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/213,192

(22) Filed: Jun. 16, 2008

(65) Prior Publication Data

US 2009/0064748 A1 Mar. 12, 2009

Related U.S. Application Data

(63) Continuation of application No. PCT/JP2007/063227, filed on Jul. 2, 2007.

(30) Foreign Application Priority Data

Aug. 14, 2006 (JP) ..... 2006-221167

(51) Int. Cl.
*B21B 19/04* (2006.01)

(52) U.S. Cl. ..... 72/97; 72/366.2

(58) Field of Classification Search ..... 72/96, 72/97, 100, 208, 209, 235, 366.2
See application file for complete search history.

(56) References Cited

U.S. PATENT DOCUMENTS 4,395,896 A * 8/1983 Yoshiwara et al. ..... 72/96
4,470,282 A * 9/1984 Hayashi ..... 72/97
5,477,719 A * 12/1995 Akiyama et al. ..... 72/97
5,636,542 A * 6/1997 Yamakawa et al. ..... 72/97
5,713,234 A * 2/1998 Yamakawa et al. ..... 72/97
7,146,836 B2 * 12/2006 Hayashi ..... 72/97

FOREIGN PATENT DOCUMENTS

JP 3021664 1/2000

(Continued)

*Primary Examiner*—Edward Tolan
(74) *Attorney, Agent, or Firm*—Clark & Brody

(57) ABSTRACT

A high quality hollow shell in which the occurrence of internal surface flaws caused by the rotary forging effect and/or shear deformation is prevented by suppressing the rotary forging frequency and shear deformation in a transient region at the stage of billet gripping and a worsening of thickness deviations in the top portion of the hollow shell is also prevented is reliably produced with preventing miss-rolling such as incomplete billet gripping and troubles in bottom withdrawal and an increase in the outer diameter of the hollow shell in the bottom portion. A billet is pierced while being rotated and advanced to produce a hollow shell, from which a seamless tube is finally manufactured, using a pair of skew rolls, a pair of disk rolls, and a plug under such conditions that each of the ratio (Dg/d) of the diameter Dg of the gorge portion of the skew rolls and the outer diameter d of the billet, the ratio (Dd/d) of the diameter Dd of the groove bottom of the disk rolls and the outer diameter d of the billet, the ratio (Dd/Dg) of the diameter Dg and the diameter Dd, the inlet face angle θ1 of the skew rolls, and the square root of the product $(Ns \times Df)^{0.5}$ of the rotational frequency Ns of the billet in a transient (non-steady state) region when billet gripping and the reduction ratio Df of the outer diameter of the billet satisfies a prescribed equation.

1 Claim, 4 Drawing Sheets

FOREIGN PATENT DOCUMENTS

| | | | |
|---|---|---|---|
| JP | 2001-340904 | * | 12/2001 |
| JP | 2002-248506 | * | 9/2002 |
| WO | WO96/21526 | | 7/1986 |
| WO | WO 2004/103593 | | 12/2004 |

* cited by examiner

PROCESS FOR MANUFACTURING A SEAMLESS TUBE

This application is a continuation of International Patent Application No. PCT/JP2007/063227, filed Jul. 2, 2007. This PCT application was not in English as published under PCT Article 21(2).

TECHNICAL FIELD

This invention relates to a process for manufacturing a seamless tube. Specifically, it relates to a process for manufacturing a seamless tube comprising piercing a billet in a piercer (a skew rolling mill) to produce a hollow shell.

BACKGROUND ART

Seamless tube is usually manufactured by the Mannesmann plug mill process or the Mannesmann mandrel mill process. In order to manufacture seamless tube by such a process, first, a solid rod-shaped billet (referred to in this description simply as a billet) is introduced into a heating furnace and heated therein to a predetermined temperature. The billet is then removed from the heating furnace and is rolled for piercing in a piercer to produce a hollow shell. The hollow shell is then rolled for elongation using a plug mill or a mandrel mill or a similar rolling mill in which primarily the wall thickness of the hollow shell is reduced. Thereafter, it is rolled for sizing using a reducing mill such as a sizer or a stretch reducer in which primarily the outer diameter thereof is reduced to manufacture a seamless tube having desired dimensions.

In Patent Document 1, the present inventors disclosed an invention in which a billet is pierced using a piercer comprising skew rolls and grooved disk rolls each having an optimized roll shape, thereby making it possible to perform piercing with high efficiency without the occurrence of miss-rolling (a state in which the advance of the material being rolled stops) while suppressing an increase in the outer diameter of the bottom portion of the resulting hollow shell under such conditions that the expansion ratio Exp (outer diameter of the hollow shell/outer diameter of the billet) is at least 1.15.

In Patent Document 2, the present inventors also disclosed an invention in which piercing of a billet is performed while controlling the rotary forging effect and preventing the occurrence of internal surface flaws by optimizing the ratio of the rotational frequency (rotating speed) of a billet in the steady state region up to the tip of a plug (as will be explained while referring to the graph in FIG. 1, this is the region from LE2 onwards in which the speed of advance of the billet becomes roughly constant after the start of piercing) to the rolling reduction of the outer diameter of the billet depending on the ratio between the diameter of the skew rolls of a piercer at its inlet and the diameter of the gorge portion of the skew rolls, the rotational frequency of billet being determined by the predetermined roll inclination angle, the piercing ratio, and the piercing efficiency.

Patent Document 1: JP 3021664 B2

Patent Document 2: WO 2004/103593

DISCLOSURE OF INVENTION

Actual piercing by a piercer may be applied to a billet made of a continuously cast material having center segregation or porosity, or to a stainless steel having poor hot deformability, for example. In this case, an increase in the outer diameter of the bottom portion of the resulting hollow shell can be suppressed if piercing is performed under rolling conditions which are suitably determined based on the invention disclosed in Patent Document 1.. However, even in accordance with such invention, it is sometimes not possible to entirely eliminate the occurrence of internal surface flaws and thickness deviations (deviations in wall thickness in a tube's circumferential direction) in the top portion of the resulting hollow shell.

In the invention disclosed in Patent Document 2, the rotary forging effect in the midportion of a billet can be suppressed by using disk rolls in which the surface of each roll which contacts the material being rolled has a cross-sectional shape with a semicircular groove. In this case, however, if the rotational frequency of a billet is small or the rolling reduction of the outer diameter of a billet is small, slippage between the skew rolls and the billet increases in a piercer, and the rotary forging effect at the time of gripping of the billet by the rolls ends up increasing. In addition, the frictional resistance between a plug of the piercer and the billet increases, thereby increasing the shearing deformation and causing the occurrence of internal surface flaws. Moreover, oscillation of the billet increases in a transient (non-steady state) region as the billet is gripped by the skew rolls, and thickness deviations of the top portion of the resulting hollow shell worsen. Furthermore, in the invention disclosed by Patent Document 2, when the expansion ratio is large, the outer diameter of the bottom portion of the resulting hollow shell may increase under some conditions of the diameter of the disk rolls and the rotational frequency of the billet. An increase in the outer diameter of the bottom portion of a hollow shell causes, when the hollow shell is subsequently rolled through grooved rolls in a mill such as a mandrel mill, an increase in the load to be applied to the grooved rolls by over-filling of the material being rolled into roll gaps between groove flange portions and a decrease in the yield.

Thus, in the inventions disclosed in Patent Document 1. or Patent Document 2, a hollow shell which is produced from a billet in a piercer may have internal surface flaws or thickness deviations found in its top portion, or an increase in the outer diameter occurring in its bottom portion, due to the properties inside the billet or its thermal deformability or resulting from the rotational frequency, the reduction ratio of the outer diameter, and other parameters of the billet when using disk rolls as tube guides in the piercer, and it was sometimes not possible to produce a hollow shell of high quality over its entire length from its top portion to its bottom portion.

In the past, a hollow shell was made freed of internal surface flaws and thickness deviations over its entire length by cutting off its top portion or by repair of the top portion, but such a measure incontrovertibly increases the manufacturing costs.

The present invention is a process for manufacturing a seamless tube characterized by comprising subjecting a billet to piercing to produce a hollow shell while rotating and advancing (translating) the billet, using a pair of cone-shaped skew rolls having a gorge portion and disposed opposite each other around a pass line, a pair of grooved disk rolls, and a plug disposed along the pass line between the skew rolls and the disk rolls, under such conditions that the ratio (Dg/d) of the diameter Dg of the gorge portion of the skew rolls and the outer diameter d of a billet which is a material being rolled, the ratio (Dd/d) of the diameter Dd of the groove bottom of the disk rolls and the outer diameter d of the billet, and the ratio (Dd/Dg) of the diameter Dg of the gorge portion of the skew rolls and the diameter Dd of the groove bottom of the disk rolls satisfy either the following Equations (1), (2), and (3) or the following Equations (1), (2), and (4), the skew rolls have an inlet face angle θ1 which satisfies the following Equation (5), and the square root of the product $(Ns \times Df)^{0.5}$. of the rotational frequency Ns of the billet in a transient (non-steady state) region when the billet is gripped by the skew rolls and the reduction ratio Df of the outer diameter of the billet satisfies the following Equation (6) which is a function of the ratio (Dg/D1) of the diameter in the gorge portion of the skew rolls and the diameter D1 of the skew rolls at the location where they contact the billet in the inlet thereof.

$$3 \leqq Dg/d \leqq 7 \quad (1)$$

$$9 \leqq Dd/d \leqq 16 \quad (2)$$

in the case of an expansion ratio Exp≧1.15

$$2 < Dd/Dg \leqq 3 \quad (3)$$

in the case of an expansion ratio Exp<1.15

$$1.5 \leqq Dd/Dg \leqq 3 \quad (4)$$

$$2.5° \leqq \theta 1 \leqq 4.5° \quad (5)$$

$$0.46 \times (Dg/D1) - 0.31 \leqq (Ns \times Df)^{0.5} \leqq 1.19 \times (Dg/D1) - 0.95 \quad (6)$$

wherein Ns=Ld×Vr/(0.5×π×d×Vf) and Df=(d−dp)/d, where Vf is the smallest speed of the billet in the direction of its advance in a transient region when the billet is gripped by the skew rolls, Vr is the average speed in the circumferential direction of the billet in the transient region when the billet is gripped by the skew rolls, dp is the roll gap of the skew rolls at the tip of the plug, and Ld is the length along the pass line from the point in which the front end of the billet gets to contact with the skew rolls to the tip of the plug, the length being determined in the manner of two dimensional geometry in a state of the skew rolls having an inclination angle of zero.

In the present invention, a "transient region" when a billet is gripped by skew rolls means the period from the time when the billet contacts the tip of a plug in a piercer until the time when the front end of the billet disengages from the skew rolls.

In a manufacturing process for a seamless tube according to the present invention, the frequency of rotary forging and shear deformation occurring in a transient region at the stage of billet gripping during piercing are suppressed. As a result, in the top portion of a hollow shell produced by piercing, the occurrence of internal surface flaws caused by the rotary forging effect and/or shear deformation can be prevented, and a worsening of thickness deviation can also be prevented, thereby preventing miss-rolling such as incomplete billet gripping or troubles in tube bottom withdrawal. In addition, an increase in the outer diameter of the bottom portion of a hollow shell can be prevented, and a hollow shell having a high quality over its entire length from its top portion to its bottom portion can be reliably manufactured.

Thus, in accordance with the present invention, when a billet is pierced with a piercer to produce a hollow shell, the occurrence of rolling defects during piercing in the transient region of both the top portion and the bottom portion of the hollow shell can be reduced or eliminated, leading to a tremendous effect of increasing the yield and productivity of hollow shells. The effect of this invention of reducing or eliminating rolling defects in the transient rolling region of both the top portion and the bottom portion of a hollow shell could not possibly be achieved based on the inventions disclosed in either Patent Document 1. or Patent Document 2. which gives no consideration at all to improving rolling defects in the transient rolling regions of both the top portion and the bottom portion of a hollow shell.

LIST OF REFERENCE NUMERALS

0: piercer, 1: skew roll, 1*a*: gorge portion, 1*b*: inlet surface, 1*c*: outlet surface, 2: plug, L1: rolling portion, L2: reeling portion, 3: billet, 4: drive mechanism, G: disk roll

BEST MODE FOR CARRYING OUT THE INVENTION

Below, the best mode for carrying out a process for producing a hollow shell according to the present invention will be explained in detail while referring to the accompanying drawings.

First, new findings which are the basis for the present invention will be explained.

In order to investigate the cause of the more frequent occurrence of internal surface flaws in the front end portion than in the mid-portion of a hollow shell in the lengthwise direction, the speed of advance of a billet at the time of piercing (the speed in the rolling direction), which is closely connected to the rotary forging effect in piercing, and the rotational speed of a billet in the circumferential direction during piercing are investigated.

A billet made of S45C with an outer diameter of 70. mm is heated to 1200° C. and subjected to piercing with a piercer having skew rolls and a plug. Specifically, piercing of the billet is carried out under conditions in which the inclination angle of the skew rolls of the piercer is 10°, the roll gap in the gorge portions of the skew rolls is 61 mm, and the plug forward amount, which is the distance in the axial direction from the skew rolls to the tip of the plug, is 38 mm, to produce a hollow shell with an outer diameter of 75 mm and a wall thickness of 6 mm.

To determine the speed of advance of a billet during piercing, a graduated plate is installed along the pass line on the inlet side of a piercer, the rear end of the billet and the graduated plate are photographed with a video camera, and based on the photographed image data, the speed of advance of the billet is calculated from the distance moved by the rear end of the billet per unit time.

To determine the rotational speed of the billet, a pin which serves as a mark is driven into the rear end surface of the billet in the vicinity of the outer peripheral edge, the movement in the circumferential direction of the pin in the rear end surface of the billet is photographed with a video camera during piercing, and based on the photographed image data, the rotational speed based on the amount of movement of the billet is calculated from the amount of movement in the circumferential direction of the pin per unit time.

Figure 1:
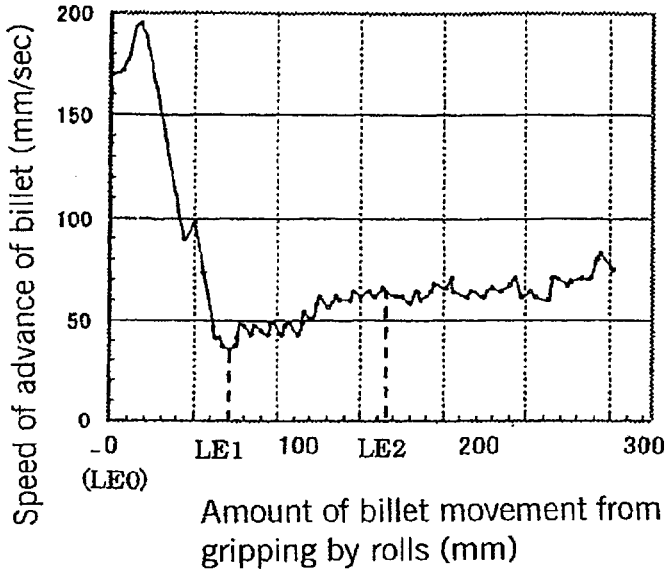
FIG. 1 is a graph showing an example of the relationship between the speed of advance of a billet (mm/sec) which is the result of measurement of the speed of advance of a billet along a pass line and the amount of movement of a billet (mm) from gripping by rolls which shows the distance of movement of the billet from the position where the billet contacts skew rolls.

FIG. 1 is a graph showing one example of the relationship between the speed of advance of a billet (mm/sec), which is the calculated speed of advance of a billet along a pass line, and the amount of movement of the billet (mm) from the time of gripping by rolls, which indicates the amount of movement of the billet from the position where the billet contacts skew rolls.

As shown in the graph of FIG. 1, the speed of advance of the billet abruptly decreases as the front end of the billet contacts the skew rolls and is gripped thereby (while the amount of billet movement changes from LE0 to LE1). When the front end of the billet reaches the location of the tip of the plug and begins to be pierced (at the point of amount of billet movement=LE1), the speed of advance of the billet reaches a minimum. As the billet continuously undergoes piercing, it is gradually stably gripped, and the speed of advance of the billet gradually increases (while the amount of billet movement changes from LE1 to LE2). Then, piercing proceeds in a steady state in which the speed of advance is nearly constant (after the point of amount of billet movement=LE2).

In contrast, the rotational speed of the billet is roughly constant in the period from when the billet contacts the skew rolls until piercing reaches the steady state.

The present inventors made the following findings from the results shown in the graph of FIG. 1. In the period from the time when a billet is gripped by the skew rolls and begins to be pierced by the plug until the time when piercing reaches a steady state, i.e., in the transient region from LE1 to LE2 in FIG. 1, the speed of advance of the billet is lower than the speed of advance in the steady state region, and the rotational speed of the billet is roughly constant throughout. Namely, it was found that when a billet is gripped by the skew rolls, slippage in the direction of advance of the billet increases in the transient region. The phenomenon shown in the graph of FIG. 1 in which the speed of a billet varies in this manner is a significant finding which was totally unknown to those skilled in the art before the present application.

The phenomenon shown in the graph of FIG. 1 in which the speed of a billet varies in this manner is expected to cause problems such as the following.

In the transient region, the frequency (number of occurrences) of rotary forging per unit length of movement in the direction of advance of the billet is larger than in the steady state region, and the rotary forging effect becomes marked. In addition, due to a slower speed of advance of the billet, the redundant shear deformation due to the frictional force between the billet and the plug increases. Due to a synergistic effect of these events, piercing of a billet in its top portion becomes unstable, and the billet produces a markedly increased oscillation at the time of piercing of the top portion of the billet. As a result, in the front end portion of the resulting hollow shell, there is much occurrence of internal surface flaws, and thickness deviations also occur markedly.

The presence of this transient region is unavoidable. The present inventors realized that it is essential to find conditions for suppressing the rotary forging effect and the redundant shear deformation, which unavoidably occur in the transient region, to a level such that they do not cause internal surface flaws at the front end portion of a hollow shell.

It is known that the rotary forging effect in a steady state region can be suppressed if the reduction ratio Df of the outer diameter of a billet is decreased or if the frequency of rotary forging N in a steady state region, which is a function of the previously set roll inclination angle β, billet diameter, and piercing ratio, is decreased.

However, merely decreasing the reduction ratio Df of the outer diameter of a billet and the frequency of rotary forging N in the steady state region does not solve the above-described problem occurring in the transient region shown in the graph of FIG. 1.

The present inventors discovered that conditions which can suppress the rotary forging effect and the redundant shear deformation, which unavoidably occur in the transient region of piercing, to an extent that they do not cause internal surface flaws to occur in the front end portion of the resulting hollow shell can be defined by using the square root of the product of the rotational frequency Ns of a billet in the transient region and the outer diameter reduction ratio Df of the billet $(Ns\times Df)^{0.5}$. as an index together with the ratio (Dg/D1). When the square root of the product of the rotational frequency Ns of a billet in the transient region and the outer diameter reduction ratio Df of the billet $(Ns\times Df)^{0.5}$. and the ratio (Dg/D1) as indices, the qualitative significance of each index is as follows.

If the outer diameter reduction ratio Df of a billet becomes small, stable billet gripping is impeded and slippage easily occurs. As a result, shear deformation caused by the frictional force between the surface of the plug and the internal surface of the billet increases, and internal surface flaws develop due to this shear deformation. The propulsive force exerted by the skew rolls is influenced by their shape. Therefore, the shear deformation caused by the frictional force between the surface of the plug and the internal surface of the billet is also influenced by the magnitude of the ratio (Dg/D1) of the diameter D1 of the skew rolls at the location in the inlet where they contact the billet and the diameter Dg in the gorge portion of the skew rolls. As stated above, if slippage increases, piercing of a billet becomes unstable, and the billet oscillates in the circumferential direction, thereby worsening the thickness deviations of the top portion of the resulting hollow shell.

If the rotational frequency Ns of the billet in the transient region is made too small by varying the inclination angle of the skew rolls, for example, the amount of movement of the billet advancing in the rolling direction during the period in which a half rotation of the billet occurs in the transient region increases, resulting in an increased reduction in wall thickness per unit rotation of the billet by the action of the skew rolls and the plug in the transient region. As a result, it becomes easy for slippage to occur between the skew rolls and the billet. Another method for decreasing the rotational frequency Ns of the billet in the transient region is to increase the inlet face angle θ1 of the skew rolls.

The magnitude of the ratio (Dg/D1) of the diameter D1 of the skew rolls at the location in the inlet where they contact the billet and the diameter Dg of the skew rolls in the gorge portion, the ratio indicating the shape of the skew rolls, influences the propulsive force exerted by the skew rolls, and ultimately it influences the occurrence of slippage and shear deformation which is produced by the frictional force between the surface of the plug and the internal surface of the billet.

Next, a piercer which is used in this embodiment will be described.

Figure 2:
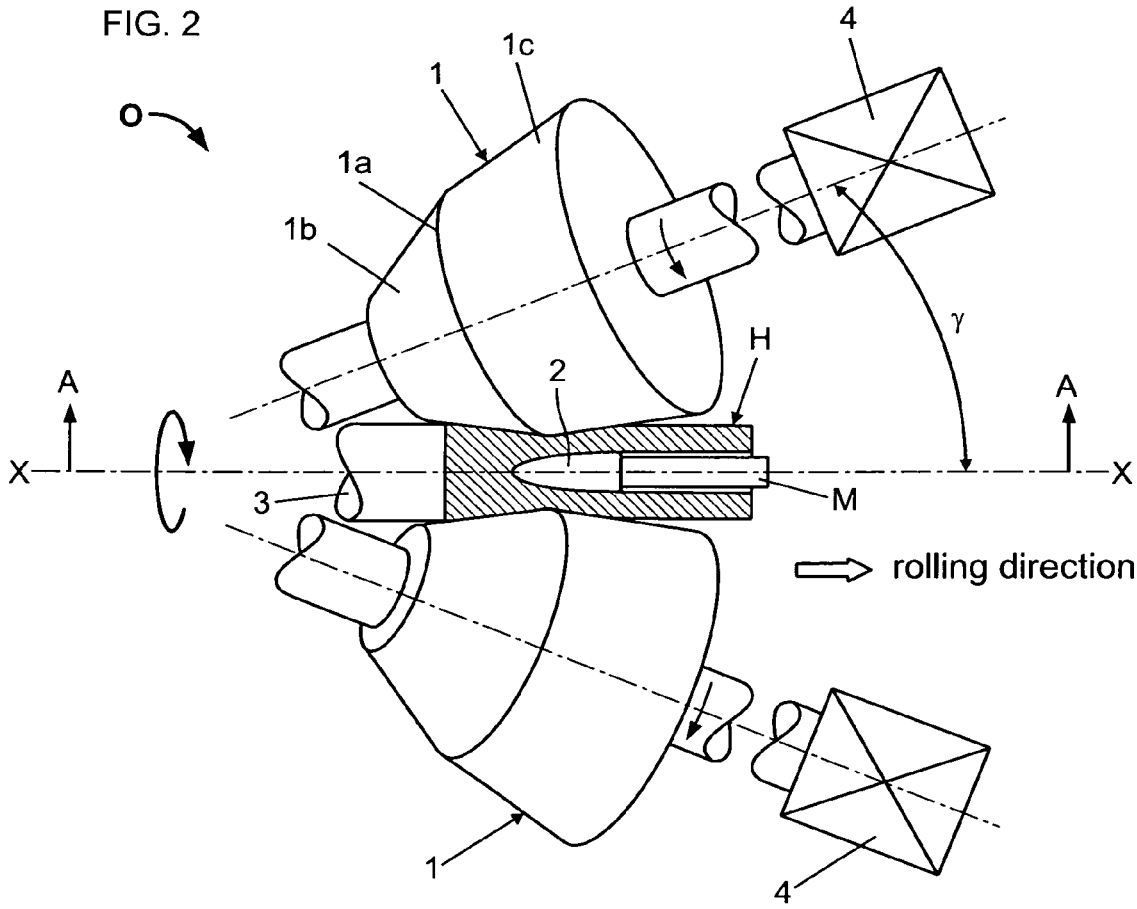
FIG. 2 is a plan view schematically showing the structure of a piercer.
Figure 3:
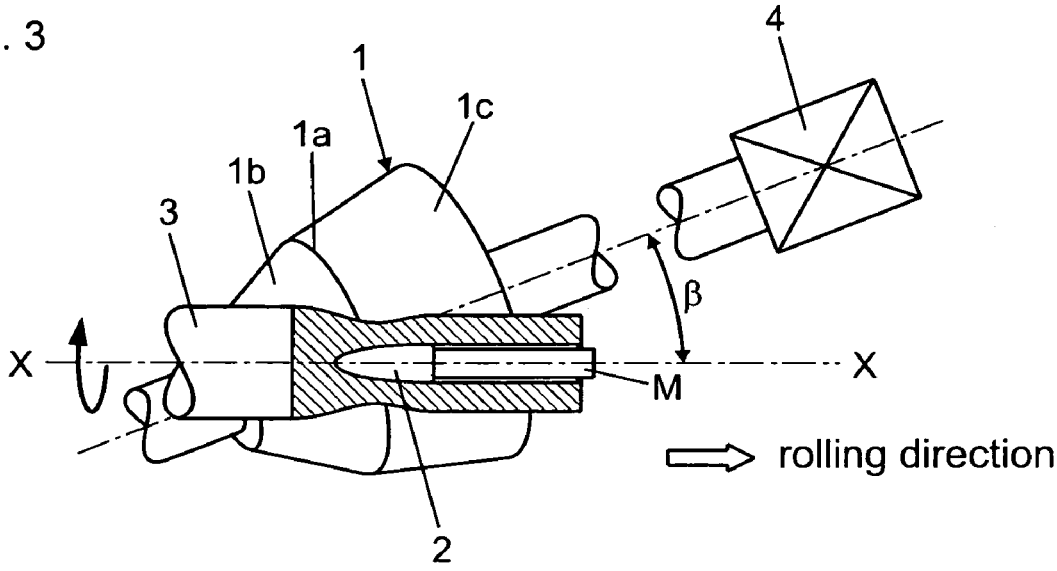
FIG. 3 is an elevation schematically showing the structure of a piercer.
Figure 4:
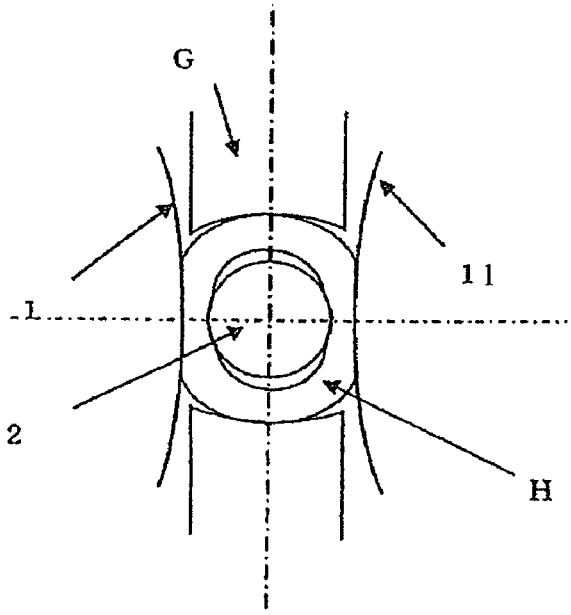
FIG. 4 is a transverse cross-sectional view schematically showing the state during piercing with a piercer.
Figure 5:
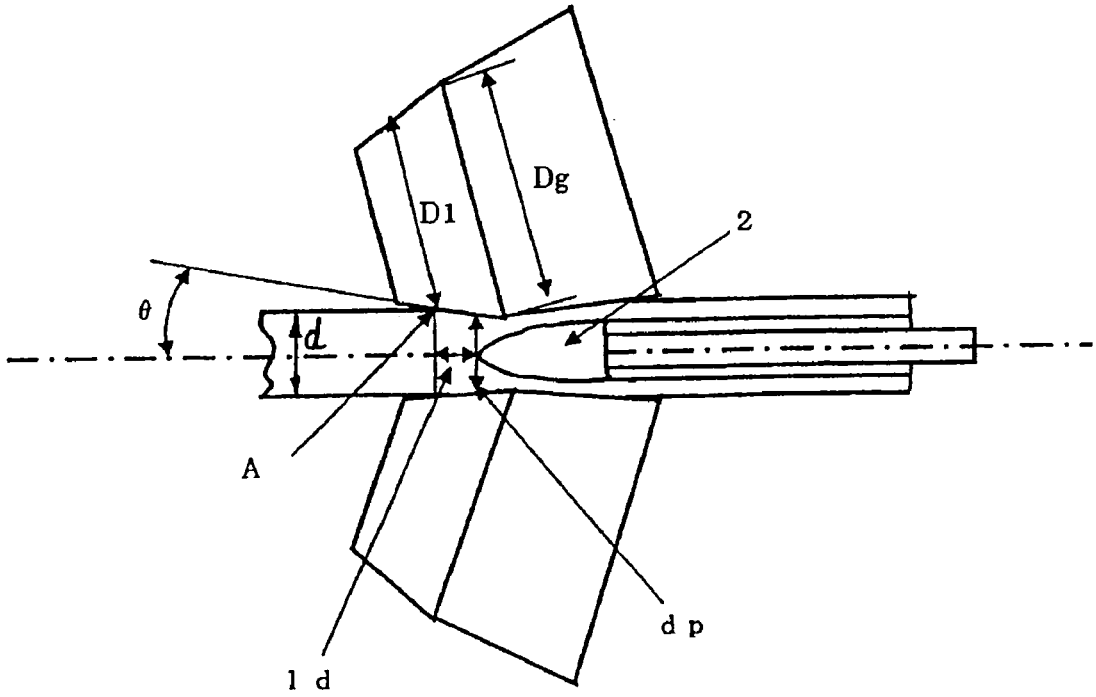
FIG. 5 is a transverse cross-sectional view schematically showing the state during piercing with a piercer.

FIG. 2 is a plan view schematically showing the structure of a piercer 0. FIG. 3 is an elevation schematically showing the structure of the piercer 0. FIGS. 4 and 5 are transverse cross-sectional views schematically showing the state in the course of piercing by the piercer 0.

In FIGS. 2-5, each skew roll 1 has a gorge portion l*a* having a roll diameter Dg at its midportion, an inlet surface 1*b*. which forms a generally truncated cone having an outer diameter which decreases towards the end of the inlet (entrance) side from the gorge portion 1*a*, and an outlet surface 1*c* which forms a generally truncated cone having an outer diameter which increases towards the end of the outlet (exit) side from the gorge portion 1*a*. As a whole, each skew roll is formed in the shape of a cone.

Each skew roll 1 is disposed so that its roll axis shown by a single-dash chain line intersects the pass line X-X at an angle γ.

As shown in FIG. 3, the skew rolls 1, 1 are disposed so as to have a reverse angle of inclination β with respect to the pass line X-X. Each skew roll 1 is rotatably driven by a drive mechanism 4.

As shown in FIG. 4, a pair of disk rolls G which are tube guides are disposed opposite each other between the skew rolls 1, 1. The disk rolls G are guide rolls having contact surfaces with the billet having a cross-sectional shape which is a semicircular groove.

Figure 6:
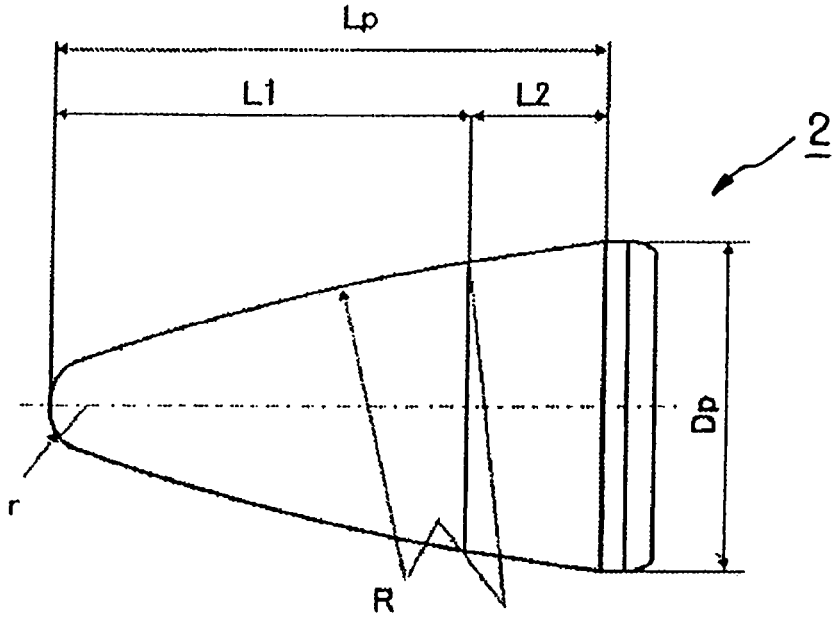
FIG. 6 is an explanatory view showing the shape of a plug.

A plug 2 is disposed between the skew rolls 1, 1 along the pass line X-X. FIG. 6 is an explanatory view showing the shape of the plug 2.

As shown in this drawing, the plug 2 generally has a tip portion r. The plug 2 is in the shape of an artillery shell with a maximum outer diameter of Dp and including a rolling portion L1 with a conical shape and a longitudinal cross section defined by a curve with a radius R and a reeling portion L2. The proximal (basal) end of the plug 2 is secured to the distal end of a mandrel bar M, and the proximal end of the mandrel bar M is supported by an unillustrated thrust block mechanism which can move in the axial direction.

In this embodiment, the plug 2 used for piercing has a shape such that the ratio (r/d) of the radius of curvature r of the tip of the plug 2 to the diameter d of the billet 3 is at least 0.085 to at most 0.19, and the ratio (R/L1) between the length L1 of the rolling portion of the plug 2 and the radius of curvature R of the rolling portion of the plug 2 is at least 1.5.

If the ratio (r/d) is less than 0.085, the service life of the plug 2 is greatly decreased due to thermal effects, while if the ratio (r/d) is greater than 0.19, slippage in the direction of advance of the billet 3 becomes large. Similarly, if the ratio (R/L1) is less than 1.5, slippage in the direction of advance of the billet 3 becomes large.

Next, the state in which piercing is carried out using this piercer 0 will be explained.

A billet 3 which has been heated to a predetermined temperature is transported on a feed table (not shown) of the piercer 0 and is gripped by the skew rolls 1, 1 along the pass line X-X.

The billet 3 gripped by the skew rolls 1, 1 advances in the direction shown by the hollow arrows in FIGS. 2 and 3 while rotating until it reaches the tip of the plug 2. During this advance, the billet 3 undergoes working by the skew rolls 1, 1 to decrease its outer diameter.

Next, the billet 3 is pierced at its center by the plug 2, and undergoes working to form a wall thickness between the plug 2 and the skew rolls 1, 1 every half rotation of the billet. As a result, it undergoes piercing to form a hollow shell H.

In this embodiment, when carrying out piercing in this manner, in order to suppress an increase in the outer diameter of the bottom portion of the resulting hollow shell, which causes problems when the hollow shell is rolled in a downstream rolling mill, the skew rolls 1 and disk rolls G which are used are selected such that (a) the ratio (Dg/d) of the diameter Dg in the gorge portion 1*a* of the skew rolls 1, 1 to the outer diameter d of the billet 3, (b) the ratio (Dd/d) of the diameter Dd in the groove bottom of the disk rolls G which are tube guides to the outer diameter d of the billet 3, and (c) the ratio (Dd/Dg) between the diameter Dg in the gorge portion 1*a* of the skew rolls 1, 1 and the diameter Dd in the groove bottom of the disk rolls G satisfy either the following Equations (1), (2), and (3) or the following Equations (1), (2), and (4), and such that the inlet face angle θ1 of the skew rolls 1, 1 satisfies the following Equation (5):

$$3 \leqq Dg/d \leqq 7 \quad (1)$$

$$9 \leqq Dd/d \leqq 16 \quad (2)$$

when the expansion ratio Exp≧1.15, $$2 < Dd/Dg \leqq 3 \quad (3)$$

when the expansion ratio Exp<1.15, $$1.5 \leqq Dd/Dg \leqq 3 \quad (4)$$

$$2.5° \leqq \theta 1 \leqq 4.5° \quad (5)$$

The reasons for the limitations of Equations (1)-(5) will be explained below.

If the ratio (Dg/d) in Equation (1) is smaller than 3, the service life of bearings will decrease due to inadequate strength of the bearings. If the ratio (Dg/d) exceeds 7, equipment costs will increase in order to suppress an increase in the outer diameter of the bottom portion of the hollow shell resulting from an increase in the wall thickness of the bottom portion of the billet. Therefore, in this embodiment, the ratio (Dg/d) is limited to at least 3 and at most 7.

If the ratio (Dd/d) in Equation (2) is less than 9, the resulting hollow shell H will suffer troubles during tube bottom withdrawal and have an increased outer diameter in the bottom portion. If the ratio (Dd/d) exceeds 16, the hollow shell H will have a large number of exterior surface flaws and an increased outer diameter of the bottom portion, and the diameter of the disk rolls G becomes large whereby the overall mill becomes large in size and equipment costs increase. Therefore, in this embodiment, the ratio (Dd/d) is limited to at least 9 and at most 16.

If the ratio (Dd/Dg) in Equation (3) is 2 or less, in the case of piercing at an expansion ratio of at least 1.15, the resulting hollow shell H will suffer troubles in tube bottom withdrawal and have an increased outer diameter in the bottom portion. If the ratio (Dd/Dg) exceeds 3, in the case of piercing at an expansion ratio of at least 1.15, the hollow shell H will have exterior surface flaws and an increased outer diameter in the bottom portion. Therefore, in this embodiment, when the expansion ratio is at least 1.15, the ratio (Dd/Dg) is limited to greater than 2 to at most 3.

If the ratio (Dd/Dg) in Equation (4) is at least 1.5, in the case of piercing at an expansion ratio of less than 1.15, there are no rolling problems in the subsequent mill due to an increase in the outer diameter of the bottom portion of the resulting hollow shell H, and the ratio may be determined from the standpoint of stability of piercing (thickness deviation and ease of billet gripping by rolls). If the ratio (Dd/Dg) exceeds 3, in the case of piercing at an expansion ratio of less than 1.15, the hollow shell H will have outer surface flaws and an increased outer diameter of the bottom portion. Therefore, in this embodiment, when the expansion ratio is less than 1.15, the ratio (Dd/Dg) is limited to at least 1.5 to at most 3.

If the inlet face angle θ1 of the skew rolls 1 in Equation (5) is either greater than 4.5° or less than 2.5°, the ease of gripping of a billet 3 by the skew rolls 1 will worsen. Therefore, in this embodiment, the inlet face angle θ1. of the skew rolls 1 is limited to at least 2.5° to at most 4.5°.

In this embodiment, a billet 3 is pierced using a piercer 0 comprising skew rolls 1, a plug 2, and disk rolls G with shapes defined by Equations (1)-(5) under conditions of rotational frequency of the billet 3 and the outer diameter reduction ratio of the billet 3, which are the settings for the rolls, satisfying Equation (6):

$$0.46\times(Dg/D1)-0.31\leqq(Ns\times Df)^{0.5}\leqq 1.19\times(Dg/D1)-0.95 \quad (6)$$

In Equation (6), Ns=Ld×Vr/(0.5×π×d×Vf) and Df=(d−dp)/d, wherein Vf indicates the smallest speed of the billet in the direction of its advance in the transient region as the billet is gripped by the skew rolls, which can be determined, for example, by collecting piercing data, using these data to approximate the speed of the billet in the axial direction in the transient region as the billet is gripped by the skew rolls by the least squares method, and employing the minimum speed in the direction of advance of the billet found by this approximation, Vr indicates the average speed in the circumferential direction of the billet in the transient region when the billet is gripped by the skew rolls, dp indicates the roll gap of the skew rolls at the tip of the plug, and Ld is the length from the position in which the front end of the billet is initially gripped by the skew rolls to the tip of the plug.

In order to solve the problems of shear deformation, thickness deviation, bottom blockage, and an increase in the outer diameter of the bottom portion which may develop depending upon the settings for the skew rolls 1, the present inventors performed a piercing test. In the test, a material which was a billet 3 with an outer diameter of 70 mm cut from the center of a larger billet 3 with an outer diameter of 310 mm made of a continuously cast carbon steel containing 0.2 mass % C and a material made of steel containing 13 mass % Cr with an outer diameter of 70 mm taken from the center of a sample with a diameter of 225 mm prepared by continuous casting following by blooming were heated to 1200° C. and subjected to piercing under the conditions shown in Table 1 using a piercer 0 satisfying above-described Equations (1)-(5). The results of the piercing test are shown in the graph of FIG. 7.

TABLE 1

| | |
|---|---|
| Dg | ϕ 400 mm |
| Dd | ϕ 1100 mm |
| Exp | 1.03-1.25 |
| θ1 | 3° |
| d | 70 mm |
| Dg/D1 | 1.06-1.28 |
| $(Ns \times Df)^{0.5}$ | 0.17-0.59 |

Figure 7:
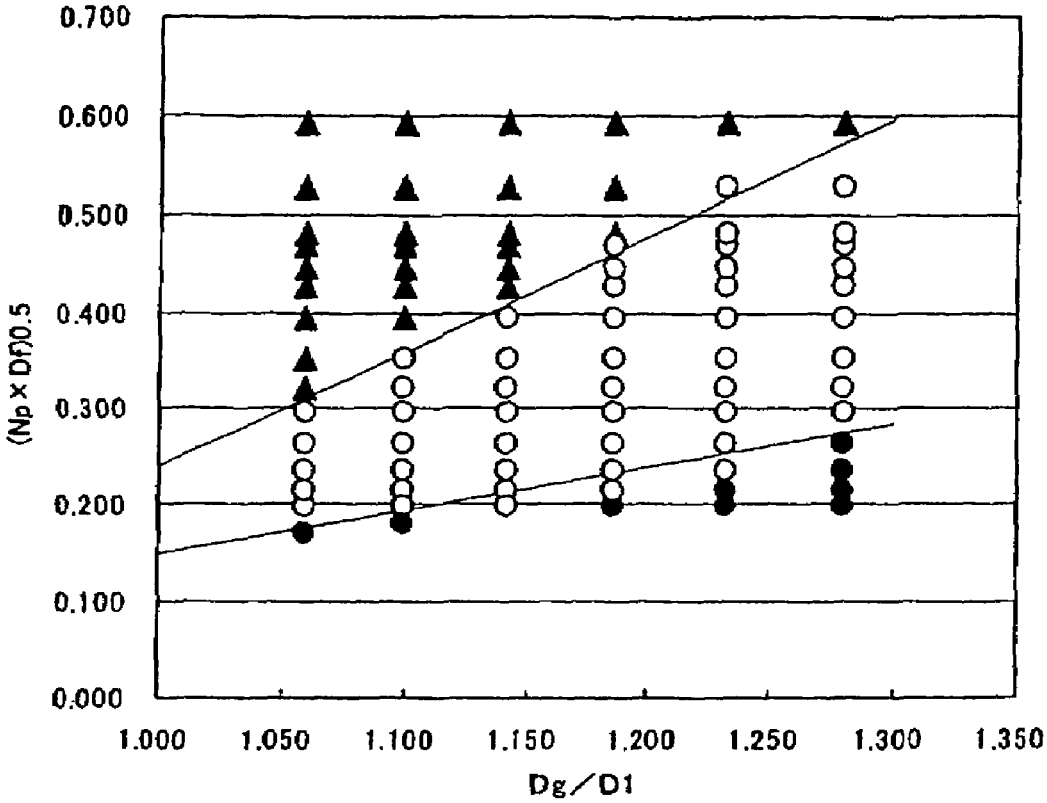
FIG. 7 is a graph showing the results of a piercing test.

In the graph of FIG. 7, the black circles indicate the case in which there was occurrence of at least one of internal surface flaws caused by shear deformation, a worsening of the thickness deviation to at least 7%, incomplete billet gripping or troubles of tube bottom withdrawal, and an increase in the outer diameter of the bottom portion exceeding 5%. The black triangles indicate the case in which internal surface flaws caused by rotary forging and/or shear deformation occurred. The hollow circles indicate the case in which a hollow shell could be produced without any problems.

From the results shown in the graph of FIG. 7, it can be seen that when the relationship defined by $\{0.46\times(Dg/D1)-0.31\}\leqq(Ns\times Df)^{0.5}\leqq\{1.19\times(Dg/D1)-0.95\}$ is satisfied, a hollow shell can be produced without problems.

Thus, if the value of $(Ns\times Df)^{0.5}$ in Equation (6) is less than $\{0.46\times(Dg/D1)-0.31\}$, problems such as the occurrence of internal surface flaws and thickness deviations, bottom blockage, and an increase in the outer diameter of the bottom portion of the resulting hollow shell develop due to an increase in the shear deformation of the top portion. On the other hand, if the value of $(Ns\times Df)^{0.5}$ exceeds $\{1.19\times(Dg/D1)-0.95\}$, the occurrence of internal surface flaws due to the rotary forging effect and shear deformation cannot be suppressed. Accordingly, in this embodiment, the value of $(Ns\times Df)^{0.5}$ is limited to at least $\{0.46\times(Dg/D1)-0.31\}$ to at most $\{1.19\times(Dg/D1)-0.95\}$.

Thus, according to this embodiment, when manufacturing a seamless tube by a process comprising piercing a billet with a piercer to produce a hollow shell, it becomes possible (a) to suppress an increase in the outer diameter during piercing, (b) to suppress the rotary forging effect and shear deformation in the top portion, thereby preventing internal surface flaws from occurring in the top portion of the hollow shell, and (c) to reduce thickness deviations in the top portion of the hollow shell. Therefore, according to this embodiment, a hollow shell having high quality with respect to dimensions and internal properties over its entire length can be produced with certainty.

EXAMPLE 1

The present invention will be explained more specifically with reference to examples.

A billet with an outer diameter of 70 mm was cut from the center of a billet of a continuously cast carbon steel containing 0.2% C having an outer diameter of 225 mm. The cut billet was heated to 1200° C. and subjected to piercing under the conditions shown in Table 2. The results of piercing are compiled in Table 3.

TABLE 2

| | |
|---|---|
| Dg | ϕ 400 mm |
| Dd | ϕ 1100 mm |
| Exp | 1.03-1.28 |
| θ1 | 3° |
| d | 70 mm |
| Dg/D1 | 1.06-1.28 |
| $(Ns \times Df)^{0.5}$ | 0.15-0.48 |

TABLE 3

| Exp | Dg/D1 | $(Np \times Df)^{0.5}$ | Internal surface flaws | Incomplete gripping | troubles in bottom withdrawal | Percent thickness deviation | Increase in bottom outer diameter | |
|---|---|---|---|---|---|---|---|---|
| 1.03 | 1.06 | 0.25 | ○ | ○ | ○ | ○ | ○ | This invention |
| 1.03 | 1.1 | 0.3 | ○ | ○ | ○ | ○ | ○ | This invention |
| 1.25 | 1.19 | 0.35 | ○ | ○ | ○ | ○ | ○ | This invention |
| 1.16 | 1.23 | 3 | ○ | ○ | ○ | ○ | ○ | This invention |

TABLE 3-continued

| Exp | Dg/D1 | $(Np \times Df)^{0.5}$ | Internal surface flaws | Incomplete gripping | troubles in bottom withdrawal | Percent thickness deviation | Increase in bottom outer diameter | |
|---|---|---|---|---|---|---|---|---|
| 1.03 | 1.06 | 0.15 | ND | X | ND | ND | ND | Comparative |
| 1.25 | 1.23 | 0.2 | ○ | ○ | ○ | X | X | Comparative |
| 1.12 | 1.28 | 0.25 | ○ | ○ | X | ○ | ND | Comparative |
| 1.03 | 1.14 | 0.48 | X | ○ | ○ | ○ | ○ | Comparative |

ND: not determinable

The mark "O" in Table 3 indicates that piercing could be performed without any problems, and the mark "X" indicates the occurrence of any of incomplete billet gripping, troubles in tube bottom withdrawal, thickness deviations, or an increase in the bottom outer diameter.

Concerning the internal surface flaws in Table 3, the case in which at least 2 flaws were observed in a region of 20-200 mm in length from the top of a hollow shell is indicated by an X.

Concerning the percent thickness deviation in Table 3, in a region of 20-200 mm in length from the top of a hollow shell, the wall thickness was measured at 8 points in the circumferential direction at a pitch of 5 mm in the lengthwise direction using a micrometer, and using the actually measured wall thickness, the percent thickness deviation in the circumferential direction was calculated at each lengthwise position as {(maximum wall thickness−minimum wall thickness)/average wall thickness at eight points}. The percent wall thickness deviations at all the positions in the lengthwise direction were averaged, and the average percent thickness deviation was used for evaluation. A percent thickness deviation of 6% or greater is indicated by an X.

With respect to the evaluation of incomplete billet gripping and troubles in tube bottom withdrawal in Table 3, the case in which at least one such defect occurred in 100 pierced tubes is indicated by an X. Concerning the percent bottom outer diameter increase in Table 3, the case in which the percentage of the maximum diameter of the bottom portion with respect to the average value of the outer diameter of the middle portion was 6% or greater is indicated by an X.

From the results shown in Table 3, it can be seen that by satisfying not only Equations (1)-(5) but also Equation (6), a hollow shell can be produced by piercing in a piercer while suppressing any of internal surface flaws of the top portion, incomplete billet gripping, troubles in tube bottom withdrawal, the percent thickness deviation, and an increase in the outer diameter of the bottom portion to a level which cause substantially no problems.

The invention claimed is:

1. A process for manufacturing a seamless tube characterized by comprising subjecting a billet to piercing to produce a hollow shell while rotating and advancing the billet, using a pair of cone-shaped skew rolls having a gorge portion and disposed opposite each other around a pass line, a pair of grooved disk rolls, and a plug disposed along the pass line between the skew rolls and the disk rolls, under such conditions that the ratio (Dg/d) of the diameter Dg of the gorge portion of the skew rolls and the outer diameter d of a billet which is a material being rolled, the ratio (Dd/d) of the diameter Dd of the groove bottom of the disk rolls and the outer diameter d of the billet, and the ratio (Dd/Dg) of the diameter Dg of the gorge portion of the skew rolls and the diameter Dd of the groove bottom of the disk rolls satisfy either the following Equations (1), (2), and (3) or the following Equations (1), (2), and (4), the skew rolls have an inlet face angle θ1 which satisfies the following Equation (5), and the square root of the product $(Ns \times Df)^{0.5}$ of the rotational frequency Ns of the billet in a transient region when the billet is gripped by the skew rolls and the reduction ratio Df of the outer diameter of the billet satisfies the following Equation (6) which is a function of the ratio (Dg/D1) of the diameter of the skew rolls in the gorge portion and the diameter D1 of the skew rolls at the location where they contact the billet in the inlet thereof:

$$3 \leqq Dg/d \leqq 7 \quad (1)$$

$$9 \leqq Dd/d \leqq 16 \quad (2)$$

in the case of an expansion ratio Exp≧1.15

$$2 < Dd/Dg \leqq 3 \quad (3)$$

in the case of an expansion ratio Exp<1.15

$$1.5 \leqq Dd/Dg \leqq 3 \quad (4)$$

$$2.5° \leqq \theta 1 \leqq 4.5° \quad (5)$$

$$0.46 \times (Dg/D1) - 0.31 \leqq (Ns \times Df)^{0.5} \leqq 1.19 \times (Dg/D1) - 0.95 \quad (6)$$

wherein Ns=Ld×Vr/(0.5×π×d×Vf) and Df=(d−dp)/d, where Vf is the smallest speed of the billet in the direction of its advance in a transient region when the billet is gripped by the skew rolls, Vr is the average speed in the circumferential direction of the billet in the transient region when the billet is gripped by the skew rolls, dp is the roll gap of the skew rolls at the tip of the plug, and Ld is the length along the pass line from the point in which the front end of the billet gets to contact with the skew rolls to the tip of the plug, the length being determined in the manner of two dimensional geometry in a state of the skew rolls having an inclination angle of zero.

* * * * *